United States Patent [19]

Baermann

[11] Patent Number: 4,638,281

[45] Date of Patent: Jan. 20, 1987

[54] MAGNETIC ROLL FOR COPY MACHINES AND METHOD FOR MANUFACTURING SAME

[75] Inventor: Horst Baermann, Rosrath-Rambrucken, Fed. Rep. of Germany

[73] Assignee: Max Baermann, G.m.b.H., Gladbach, Fed. Rep. of Germany

[21] Appl. No.: 718,637

[22] Filed: Apr. 1, 1985

[30] Foreign Application Priority Data

Nov. 26, 1984 [EP] European Pat. Off. ..... 84114262

[51] Int. Cl.[4] ..... H01F 3/00

[52] U.S. Cl. ..... 335/303; 335/306; 118/657; 29/607

[58] Field of Search ..... 335/303, 306; 29/607; 118/657, 658; 355/3 DD

[56] References Cited

U.S. PATENT DOCUMENTS

| | | | |
|---|---|---|---|
| 3,208,296 | 9/1965 | Baermann | 118/657 X |
| 3,641,969 | 2/1972 | Hakanson | 118/658 X |
| 3,663,850 | 5/1972 | Phelon | 335/306 X |
| 4,558,294 | 12/1985 | Yamashita | 335/303 |
| 4,580,121 | 4/1986 | Ogawa | 335/303 |

FOREIGN PATENT DOCUMENTS

| | | |
|---|---|---|
| 1218287 | 6/1966 | Fed. Rep. of Germany . |
| 3402864 | 8/1984 | Fed. Rep. of Germany . |
| 3314885 | 10/1984 | Fed. Rep. of Germany . |

*Primary Examiner*—George Harris

*Attorney, Agent, or Firm*—Body, Vickers & Daniels

[57] ABSTRACT

A magnetic roll for electro-photographic copy machines is provided with a carrier to which strip-shaped permanent magnetic components are fastened in an axial direction. Recesses are provided in the carrier having a cross-section larger than the magnetic components so as to permit selective radial, tangential and pivotal movement for universal positioning of the components within the recess. The components are selectively oriented to provide a predetermined induction value as measured at a predetermined distance outwardly of the carrier or with respect to adjacent poles as determined by discretely located Hall probes. The permanent magnetic components are fixed in the prescribed orientation by an injection moldable plastic material such as a plastic foam.

30 Claims, 9 Drawing Figures

FIG. 1
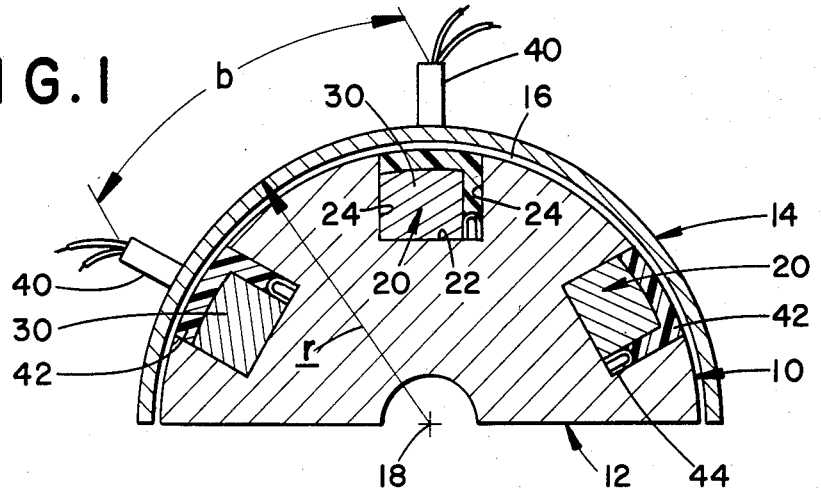
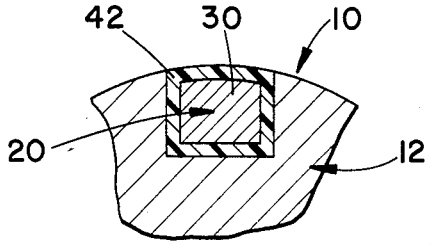
FIG. 2
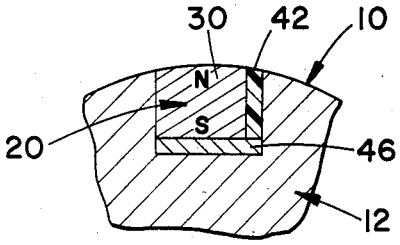
FIG. 3
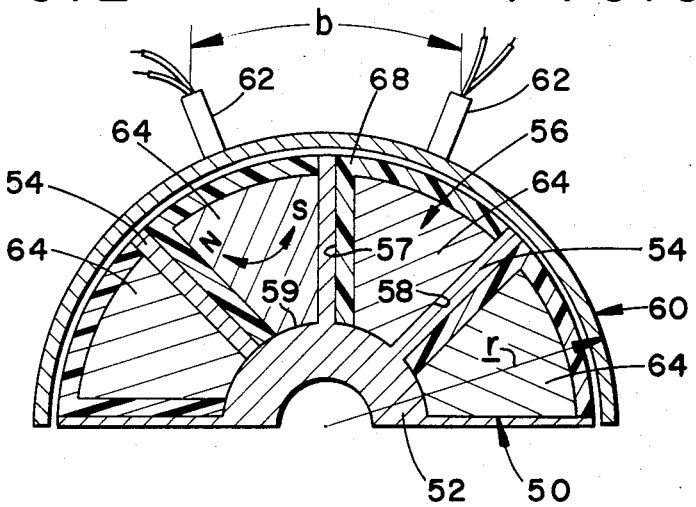
FIG. 4
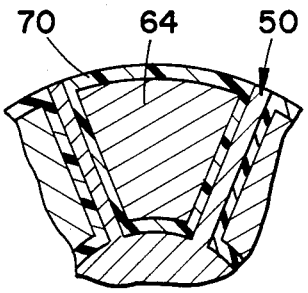
FIG. 5
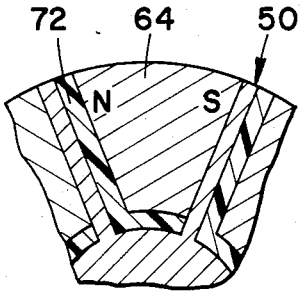
FIG. 6
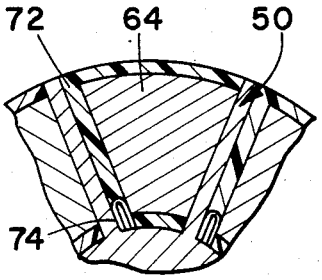
FIG. 7

MAGNETIC ROLL FOR COPY MACHINES AND METHOD FOR MANUFACTURING SAME

BACKGROUND

The present invention relates to electro-photographic copy machines, and in particular, to magnetic rolls for electro-photographic copy machines and a method of manufacturing such rolls.

In electro-photographic copy machines, magnetic rolls are concentrically surrounded by a toner tube, with a small controlled gap existing therebetween. Such magnetic rolls are generally made from a diamagnetic material. In operation, the toner tube is rotated relative to the magnetic roll about a common axis. The magnetic roll in combination with the toner tube is effective for conveying ferro-magnetic toner powder from a powder material container onto the carrier material which effects an electrostatic picture. For proper operation of such a process, it is particularly important that the toner tube provides an evenly dispersed powder layer in the range of the developing zone. This result can be accomplished only if a precisely controlled induction is obtained at each pole in the operating range of the magnetic roll.

Certain current copy machines employ magnetic rolls consisting of a pair of axially spaced support discs carrying at their outer peripheries a circumferential series of axially extending, strip-shaped, plastic-bonded permanent magnets. Typically, the support discs are made of a non-magnetic material such as aluminum, and the magnets are a sintered or plastic-bound permanent magnetic material, such as barium or strontium ferrite. Examples of magnetic rolls for such copying machines are shown in German patents DE-AS 12 18 287, DE-OS 33 14 885 and DE-OS 34 02 864.

The plastic bonded, permanent magnets are generally formed as extruded magnetized strips. The individual strips are assembled into axial slots on the support discs and suitably attached thereto. Such assembly procedures cause mechanical and magnetic deviations from the required tolerances. This creates an uneven induction along the circumference and length of the magnetic roll, and consequently on the toner tube. Such deviations lead to the undesirable imprinting of striped areas on the finished copy. Further, under the machine operating temperature, the strips are subject to thermal distortion, further accentuating the problem. In certain types of magnetic rolls, a homogeneous field is required for all the magnetic strips at the circumference of the toner tube. For other types of copy machines, the magnetic rolls carry magnetic strips of differing inductive strength with respect to one or several neighboring poles.

During the production of such magnetic rolls, it is extremely difficult to get the required uniformity of the density of flux for each of the various poles. This is generally prescribed as an inductive level at a given radius from the axis of the magnetic roll, commonly the outer radius of the toner tube. Such variations in addition to the others are common to both sintered and plastic bonded permanent magnets and are caused by various manufacturing factors such as shrinkage and/or magnetic deviations due to different qualities of the magnetic material mixture, and in the manner of production and magnetization. Heretofore, it has not been possible to obtain consistently uniform mechanical and magnetic properties on a roll to roll basis. In order to achieve greater uniformity, it is commonplace to use permanent magnets of varying induction and to selectively assemble the magnetic rolls to provide for the requisite pole strengths. Such approach results in high assembly costs and a considerable inventory of magnets with the varying induction characteristics. While it is theoretically possible to produce magnetic rolls for the copiers requiring inductions of varying intensity through the use of permanent magnets which are not magnetized to full saturation for the poles with lower inductions, such processes are not realistically feasible. Such incomplete magnetization has a disadvantage of a gradual decrease in the magnetic induction for the partially saturated poles. This leads to a loss in magnetic induction during the course of time and ultimately low quality copies.

BRIEF SUMMARY OF THE INVENTION

The present invention overcomes the aforementioned disadvantages and limitations of prior magnetic rolls, by providing a magnetic roll for electro-photographic copying machines having precisely controlled and accurately oriented permanent magnetic components. The invention precisely locates the magnetic strips at the desired inductive level with great precision and avoids mechanical and magnetic deviations at the circumference of the magnetic roll, notwithstanding normal production deviations from prescribed mechanical and magnetic tolerances. This is accomplished in a magnetic roll of the aforementioned constructions, by providing strip-shaped permanent magnetic components which are adjustably arranged on a carrier by selective radial and/or tangential shifting, and/or universal rotation in such a way that the magnetic induction from each pole reaches a predetermined value at a desired radius and/or angle with respect to the neighboring poles. After the desired selected positioning of the strips, the same may be affixed to the carrier by means of physical clamping elements, adhesives, injection moldable plastic materials or foam, or by encapsulation within a molded carrier body. Generally, the orientation of the strips is determined by a Hall probe which is arranged on a given radius or arc with respect to the axis of the magnetic roll. The strips are individually oriented with respect to the carrier until the predetermined induction is indicated at the individual probes. Thereafter, the strips are fixedly secured to the carrier resulting in an assembled magnetic roll having the prescribed induction characteristics and in a manner which is accurately repeatable from roll to roll.

Accordingly, it is an object of the present invention to manufacture magnetic rolls for electro-photographic copy machines having uniformly prescribed induction values notwithstanding individual magnets deviating from prescribed magnetic and mechanical values.

Another object of the present invention is to manufacture magnetic rolls suited for electro-photographic copy machines demanding a homogeneous magnetic field at the circumference of the toner tube and to provide a prescribed induction with respect to neighboring poles of alternate polarity for copy machines demanding a varying magnetic field.

A further object of the present invention is to provide a magnetic roll and method of manufacture therefor which reduces the inventory of permanent magnets required for assembly.

Still another object of the present invention is to provide a method for precisely adjusting the permanent magnetic components on magnetic rolls for copy machines to predetermined induction values by simple means and in a simplified manner.

Still a further object of the present invention is the provision of a magnetic roll which can be used for a broad range of currently used electro-photographic copy machine systems.

BRIEF SUMMARY OF THE DRAWINGS

The above and other advantages and benefits of the present invention will become apparent upon reading the following detailed description taken in conjunction with the accompanying drawings which:

FIG. 1 is a partial vertical cross-sectional view of a magnetic roll in accordance with the invention;

FIG. 2 is a fragmentary cross-sectional view of an embodiment of the magnetic roll of FIG. 1;

FIG. 3 is a view similar to FIG. 2 showing a further embodiment of the magnetic roll of FIG. 1;

FIG. 4 is a partial vertical cross-sectional view of a further embodiment of the magnetic roll according to the invention;

FIG. 5 is a fragmentary cross-sectional view of an embodiment of the magnetic roll of FIG. 4;

FIG. 6 is a view similar to FIG. 5 of another embodiment of the magnetic roll of FIG. 4;

FIG. 7 is a view similar to FIG. 5 of another embodiment of the magnetic roll of FIG. 4;

DETAILED DESCRIPTION OF THE PREFERRED EMBODIMENT

Figure 8:
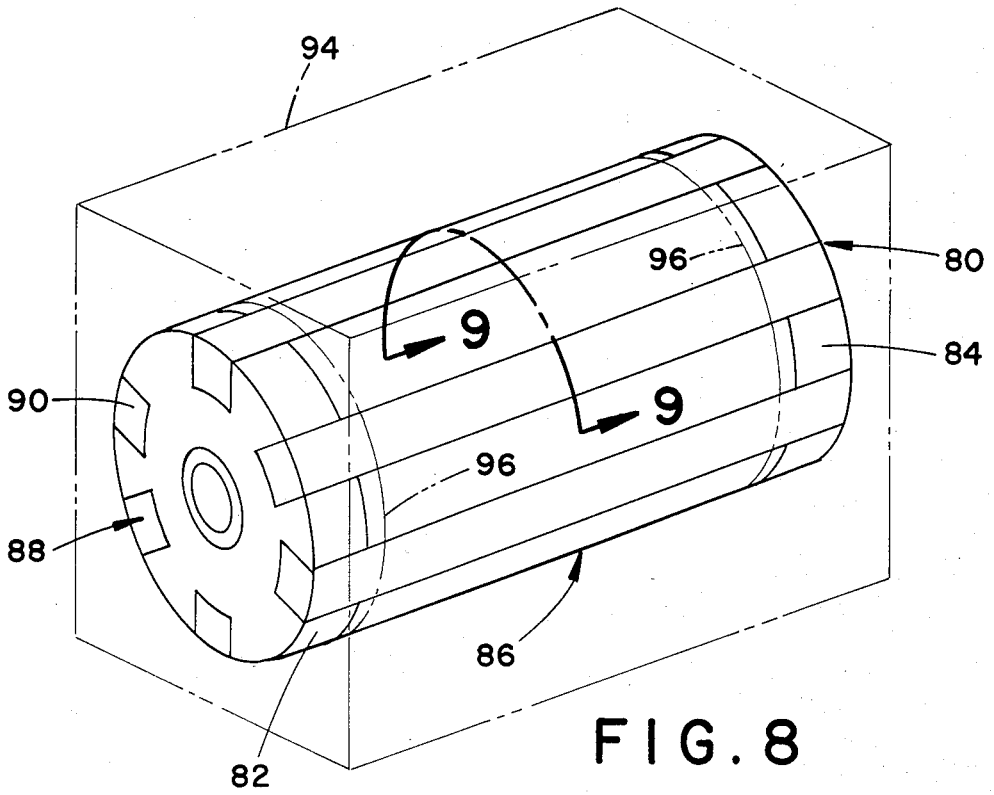
FIG. 8 is a perspective view of a further embodiment of the magnetic roll according to the present invention; and, FIG. 9 is a cross-sectional view taken along line 9—9 in FIG. 8.

Referring to the drawings for the purposes of illustrating the preferred embodiments of the present invention only, and not for limiting same, FIG. 1 shows a magnetic roll 10 comprising a non-magnetic carrier 12 which is concentrically surrounded by a cylindrical toner tube 14 made of a diamagnetic material such as aluminum or non-magnetic steel. The outer surface of the carrier 12 is radially inwardly spaced from the inner surface of the toner tube 14 at a constant width circumferential airgap 16. By means of a bearing shaft, not shown, the magnetic roll 10 is rotatable relative to the toner tube 14 about a common axis 18.

The carrier 12 is formed with a plurality of circumferentially disposed outwardly opening axial recesses 20. The recesses 20 are defined by a planar base wall 22 and parallel side walls 24. The base wall 22 is located perpendicular to a radial plane through the center of the recess 20 and the axis 18, and the side walls 24 are symmetrically spaced with respect thereto. A plurality of strip-shaped, permanent magnets 30 are adjustably arranged in the recesses 20. In cross-section, the recesses 20 are larger than the permanent magnets 30 to provide for universal positioning of the magnets 30 within the recesses 20 as described in greater detail below. The magnets 30 have a generally square shaped cross-section, however they may be circular, annular, segmental, oval, rectangular or the like.

In assembly, the individual magnets 30 must provide a predetermined induction value at a given radius "r" and/or an arc "b" between the neighboring magnetic poles. Generally, the radius r is prescribed at the outer cylindrical surface of the toner tube 14, and the angle b represents the included angle between radial planes through the axis 18 and the centers of the associated recesses 20. The required induction values and consequent positioning of the magnetic strips are accomplished by providing Hall induction probes 40 at the given radius r. For each magnetic strip, a number of such probes 40 may be axially aligned along the length and circumference of the roll. The probes 40 are effective for determining the induction level at the radius r as provided by the individual magnetic strip. In actual practice, the probes will be positioned by a suitable fixture at the prescribed radius r and angles b before the toner tube is assembled therewith.

The magnetic strips 30 are adjusted in the recess 20 of the carrier 12 by selective radial, tangential or universal rotation about pitch, yawl and roll axes until the various probes 40 indicate that the predetermined induction value is obtained. During such shifting, the individual strips may be carried by any suitably adjustable holding device. When the desired magnetic values have been attained for the various strips, they may be fixed within the recess by means of an injection moldable plastic material 42. The material 42 adheres to the surfaces of the magnets 30 and the recess 20, filling the latter and preferably conforming to the outer surfaces of the carrier 12, as well as fixedly retaining the magnet in the desired prescribed position. The magnets may be also fastened by other adhesives or cast resins or plastic foams. The magnets, as shown in FIG. 1, also may be fixed by suitable adjustable clamping elements 44, such as springs, before such materials are injected into the recesses, thereby avoiding the need for separate fixture devices. The magnets may also be sized so as to be located within the recess and totally encapsulated by the plastic material 42 as shown in FIG. 2. Further, as shown in FIG. 3, the magnetic strip may be retained in the recess by plastic material 42 retained solely at the side wall. Additionally, the base of the recess 20 may be provided with a support strip 46 to provide increased rigidity in assembly as well as increased induction of the magnets. Further, the magents may be located within the recesses to provide for alternating orientation of the plastic material against the right and left side walls 24 of the recess 20.

Referring to FIG. 4, the carrier 50 is provided with an annular central hub 52 and a plurality of radially extending axial ribs 54. The mutually facing surfaces of the ribs 54 define axially extending radially outwardly opening recesses 56 of a segmental cross-section. More particularly, the recesses 56 are defined by circumferentially spaced radial side walls 57, 58 and a cylindrical base wall 59. The orienting of the magnets carried within the recesses 56 is similar to the aforementioned construction. Therein, with the toner tube 60 removed, the Hall probes 62 are positioned at a radius r corresponding to the outer circumferential surface of the toner tube 60 and mutually circumferentially spaced at a predetermined arc b. The permanent magnets 64 have a segmental cross-section, smaller in dimension than the recesses 56 to permit radial tangential and universal rotation of the magnets 64 within the confines of the recess 56. The Hall probes 62 are used in the aforementioned manner to indicate when the predetermined induction value is attained for the individual magnets. After final positioning, the recesses 56 are filled with an injection moldable plastic material 68 having an outer surface conforming to the outer cylindrical surface of the carrier 50 and occupying the remaining portion of the recess 56.

As shown in FIG. 5, after selective positioning of the magnetic strips, plastic material 70 in the recess may encapsulate the magnet 64. Further, as shown in FIGS. 6 and 7, the plastic material 72 may be alternately located along the left or right side wall of the recess 56. Prior to injection of the moldable plastic material, the individual magnets may be held in position by means of clamping members 74.

Referring to FIG. 8, the carrier 80 may consist of two axially separated discs 82, 84 at the ends of the magnetic roll 86. The discs 82, 84 are provided with circumferential slots 88 conforming to the various aforementioned recesses. The magnets 90 are arranged and adjusted in the aforementioned manner to provide predetermined induction values at the prescribed radius and arc by means of the Hall probes. Thereafter, the magnets 90 are fixed in the desired adjusted position by means of the plastic material or other suitable adhesives. Thus, with this construction, a cylindrical hollow body is attained, with the magnets 90 constituting the axial connecting members between the individual end discs 82, 84. With this assembly, the hollow body may be filled with a suitable plastic foam by means of injection molding. Conventionally, this involves placing the magnet roll sub-assembly into a correspondingly constructed mold and injection molding the plastic material or foam by conventional techniques. The mold 94 is generally shown by the dashed lines. With such assembly, the end discs 82, 84 may be severed from the molded body generally along the dashed circumferential lines 96. This particular construction provides a light weight magnetic roll which also is resistant to deformation. The end discs may be omitted if the mold is multi-sectional and equipped with laterally removable plates having corresponding recesses for fastening and adjusting the permanent magnetic components.

Figure 9:
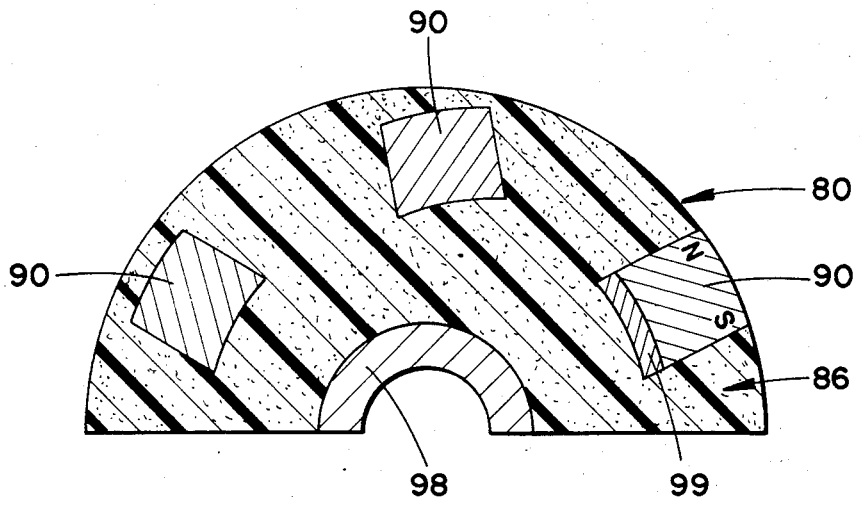

In vertical cross-section, the magnetic roll as shown in FIG. 9 is completely formed of the plastic foam which serves to retain the adjusted permanent magnetic strips in their variously illustrated positions. Further, the molded body may be provided with a central bushing 98. molded in place during the injection molding process. A supporting base strip 99 may also be employed.

With such constructions, the injection moldable plastic material or foam must be injected at a temperature range where the magnetic strips are not deformed. At the same time, the molded material, once cooled down, must also be resistant against deformations when the copy machine is heated in operation. For this purpose, it is preferred to use a polyurethene foam or its derivitives. Alternatively, phenolic molding compounds may be used.

The permanent magnets may be made in a conventional manner of sintered, highly coercive permanent magnet materials such as barium ferrite, strontium ferrite, cobalt-rare earth alloys, as well as neodymium iron. It is preferred however, to make the magnets out of a mixture of a thermal plastic binder and a high coercive magnetic material such as barium or strontium ferrite in powder form. A mixture of both magnetic materials may also be used.

The magnets may be made by extrusion or injection molding. They may be either formed directly as strips or cut into strip form from larger sheets. They may also be press molded using the aforementioned magnetic materials, particularly if the thermosetting plastic materials such as phenolic resins are used as the binder. In cross-section, magnetic strips may have any shape required for the desired induction values. While they are beneficially rectangular or segmental in cross-section, annular, oval or circular sections may also be used.

The permanent magnetic components can be magnetized in accordance with the roll design required for the particular copy machine system. As shown in FIG. 3, the magnets may be magnetized in the radial direction wherein the north pole N is oriented towards the toner tube while the counter pole S is opposite thereto. The magnets may also be magnetized in the tangential direction as shown in FIG. 6. The magnets may also be magnetized in an arcuate pattern as shown in FIG. 4. In each of the aforementioned pole orientations, the arrangement is such that the various poles have a circumferentially alternating polarity. Further, each of the strip configurations may be provided with supporting base strips 46, 99 which increase the rigidity of the strips in assembly, which technique is particularly useful in the hollow configuration. Further, such base strips may consist of a magnetic, non-conductive material such as aluminum. However, they also may be formed of a ferro-magnetic material such as soft iron. This is particularly effective for magnetization in the radial direction, increasing the induction of the magnet in a well known manner.

The above and other variations of the above embodiments may thus be used to provide for uniform manufacture of copying rolls regardless of the magnet induction arrangement being employed.

It is claimed:

1. A magnetic roll for electro-photographic copying machines, comprising: a carrier having a longitudinal axis; a circumferentially spaced series of elongated permanent magnetic components extending axially on said carrier; said magnetic components having radially outwardly extending flux fields; and, means for selectively and independently rigidly positioning each magnet radially and circumferentially relative to said carrier so that the induction of each magnetic pole cooperates with the induction at neighboring poles to provide a predetermined magnetic field extending radially outwardly from said roll.

2. The magnetic roll as recited in claim 1 wherein positioning means comprise clamping elements.

3. The magnetic roll according to claim 1 wherein said positioning means comprises an adhesive.

4. The magnetic roll as recited in claim 1 wherein the positioning means comprises a plastic material.

5. The magnetic roll as recited in claim 1 wherein said carrier is provided with the plurality of axially extending, outwardly opening recesses having a larger cross-section than said components sufficient to permit said positioning of said component therewithin.

6. The magnetic roll as recited in claim 5 wherein said recesses on the carrier are defined by a number of radially outwardly projecting axially extending ribs formed on a central hub body.

7. The magnetic roll as recited in claim 5 wherein said carrier consists of two axially spaced, disc-shaped bodies having a plurality of circumferentially spaced recesses in which said components are universally adjustably fixed thereby forming a roll-shaped hollow body, the interior of said body being filled with an injection moldable plastic material.

8. The magnetic roll as recited in claim 7 wherein said disc-shaped bodies may be severed from the roll while retaining the desired inductive properties for the roll.

9. The magnetic roll as recited in claim 8 wherein said carrier consists of an injection moldable plastic material encapsulating said components at the desired positions.

10. The magnetic roll as recited in claim 9 wherein the plastic material comprises a polyurethene foam or derivitives thereof.

11. The magnetic roll as recited in claim 9 wherein the plastic material comprises a phenolic resin.

12. The magnetic roll as recited in claim 1 wherein said components are formed of a highly coercive permanent magnetic material selected from the group of barium ferrite, strontium ferrite, cobalt-rare earth alloys or neodymium iron.

13. The magnetic roll according to claim 1 wherein said components are made of sintered material.

14. The magnetic roll as recited in claim 13 wherein the permanent magnetic components comprise a mixture of a thermoplastic binder and a highly coercive permanent magnetic material in powder form.

15. The magnetic roll as recited in claim 14 wherein said binder includes a curable thermosetting plastic material.

16. The magnetic roll as recited in claim 1 wherein said components have an annular circular, rectangular, oval, square or segmental cross-section.

17. The magnetic roll as recited in claim 1 wherein said components are magnetized in a radial direction so that one pole is located adjacent the outer surface while the outer pole is located on an inner surface opposite thereof.

18. The magnetic roll as recited in claim 1 wherein said components are magnetized in a tangential direction so that the poles of different polarity are situated on the surface of said components in an angle perpendicular to a radial plane through the axis.

19. The magnetic roll as recited in claim 1 wherein said components are magnetized in the form of an arc such that the poles of alternating polarity are formed at the surface and directed outwardly therefrom.

20. The magnetic roll as recited in claim 1 wherein said components are affixed to axial supporting bodies.

21. The magnetic roll as recited in claim 20 wherein said supporting bodies are formed of a magnetically non-conductive material.

22. The magnetic roll as recited in claim 21 wherein said supporting bodies consist of a magnetically high conductive material.

23. A method of manufacturing magnetic rolls for electro-photographic copy machines having strip shaped permanent magnetic components axially supported by a carrier member, said magnetic components having radially outwardly extending flux fields, comprising the steps of: radially and circumferentially positioning each of said components individually on said carrier such that the induction of each magnetic pole cooperates with the induction at neighboring poles to provide a predetermined magnetic field extending radially outwardly from said roll; and, after said positioning, fixedly securing said components to said carrier by means of an injection moldable plastic material.

24. The method as recited in claim 23 including providing said carrier with axial recesses of larger cross-sections than the components sufficient to permit said positioning of said components within said recesses.

25. The method as recited in claim 23 including mounting said components on spaced disc-shaped portions of the carrier and universally adjusting said components relative to said disc-shaped portions to provide a predetermined induction value, fixing said components to the disc-shaped portions and molding a plastic foam into the spaced defined by said disc-shaped portions and said components to form a molded body.

26. The method as recited in claim 25 including severing said disc-shaped portions from said molded body to provide a predetermined cylindrical length.

27. The method as recited in claim 24 wherein the remaining space in said recesses is filled by said injection moldable plastic material.

28. The method as recited in claim 23 wherein Hall induction probe means are located at predetermined distances with respect to said carrier member, and said components are positioned with respect to said carrier member to provide said predetermined magnetic field as determined by said Hall probe means.

29. The method as recited in claim 28 wherein said probe means comprise a plurality of axially oriented sets located at said predetermined distance and adjacent sets are circumferentially spaced to provide a predetermined induction between said sets.

30. The method as recited in claim 28 wherein a cylindrical toner tube includes said magnetic rolls in assembly and said probe means are located at said predetermined distance corresponding to the outer cylindrical surface of said toner tube.

* * * * *